US005992065A

United States Patent [19]

Preiser

[11] Patent Number: 5,992,065

[45] Date of Patent: Nov. 30, 1999

[54] AERIAL MESSAGE SYSTEM

[75] Inventor: Gerard A. Preiser, Naples, Fla.

[73] Assignee: Arthur H. Bond, Plantation, Fla.

[21] Appl. No.: 09/009,725

[22] Filed: Jan. 21, 1998

Related U.S. Application Data

[60] Provisional application No. 60/035,683, Jan. 24, 1997.

[51] Int. Cl.[6] ..... G09F 21/16; G09F 21/06

[52] U.S. Cl. ..... 40/213; 40/212

[58] Field of Search ..... 40/212, 213

[56] References Cited

U.S. PATENT DOCUMENTS

| | | | |
|---|---|---|---|
| 1,426,413 | 8/1922 | Savage . | |
| 1,850,635 | 3/1932 | Reed, Jr. . | |
| 1,986,942 | 1/1935 | Remey . | |
| 2,345,152 | 3/1944 | Remey . | |
| 2,345,153 | 3/1944 | Remey | 40/213 |
| 2,345,154 | 3/1944 | Remey | 40/213 |
| 2,674,820 | 4/1954 | Hansen . | |
| 3,089,271 | 5/1963 | Copeland | 40/213 |
| 3,114,214 | 12/1963 | Pike et al. | 40/213 |
| 3,151,410 | 10/1964 | Stinis | 40/213 |
| 4,122,618 | 10/1978 | Gay | 40/213 |
| 4,561,201 | 12/1985 | Sanborn | 40/213 |

FOREIGN PATENT DOCUMENTS 2191319 12/1987 United Kingdom .

*Primary Examiner*—Anthony Knight
*Assistant Examiner*—Marcus Dolce
*Attorney, Agent, or Firm*—Richard C. Litman

[57] ABSTRACT

An aerial message system uses a plurality of aircraft flying in formation to form a visible message in the sky. A lead or master aircraft carries a small computer which may be programmed with the message(s) to be formed, as well as other factors such as the true airspeed of the aircraft and the configuration of the formation. An interface and encoder are placed between the computer and a transmitter aboard the lead aircraft, with the interface and encoder serving to accept a signal from the computer which is compatible with a dot matrix printer, and reformatting the signal to output to the transmitter. The transmitter transmits a plurality of discrete pulses or signals to the receiving or slave aircraft, with each of the slave aircraft receivers being tuned or adjusted to receive a signal corresponding to the position of that aircraft in the formation. The receivers may be readjusted in the air to allow aircraft to exchange positions in the formation, in order to maximize efficiency of the smoke or vapor material being carried on each aircraft. The signals received by each aircraft (including the lead aircraft with its hard wired output) control solenoids which operate injector nozzles within the engine exhaust system for each aircraft. Thus, a formation flight of aircraft equipped with the present system may form an aerial advertising or display message quickly and efficiently, with the computer adjusting output signals in other than real time to adjust for different formations.

14 Claims, 3 Drawing Sheets

AERIAL MESSAGE SYSTEM

REFERENCE TO RELATED PATENT APPLICATION

This application claims the benefit of U.S. Provisional Patent Application Serial No. 60/035,683, filed on Jan. 24, 1997.

BACKGROUND OF THE INVENTION

1. Field of the Invention

The present invention relates generally to aerial message and display means using visible vapor distributed from one or more aircraft (e. g., "skywriting"), and more specifically to a system wherein a plurality of aircraft fly in formation, with each aircraft producing a relatively short puff of vapor controlled by a computer in a master aircraft. The master aircraft transmits an appropriate signal to a receiver in each of the other aircraft, according to the message to be displayed. A specially adapted interface and encoder device is placed between the computer and the transmitter in the master aircraft, enabling the computer to communicate with the transmitter in the same manner used in controlling a dot matrix printer.

2. Description of the Prior Art

The concept of "skywriting," i. e., maneuvering a single aircraft to produce one or more words using a visible vapor emanating from the engine exhaust or other source, has been known since shortly after the development of the first practical powered aircraft. Such displays always attract attention, as a pattern of smoke or vapor which forms words or designs in the sky is most unusual, and its location enables it to be seen for miles.

The basic concept utilizes only a single aircraft to produce one or more words or designs, which leads to several problems. First, any skywriting procedure requires that the aircraft fly relatively high (generally on the order of two miles above the surface), to avoid turbulent air at lower altitudes which would quickly break up any message or display, most likely before its completion. This leads to a second problem, in that the single aircraft must produce the entire message, a relatively slow procedure in which the first portion of the message often dissipates before the message is completed, even in stable air. A third problem with this technique is that the single aircraft must produce a prodigious amount of vapor or smoke, in order for the strokes formed to be seen clearly from such a high altitude. This leads to rapid depletion of the supply of oil or other material carried in the aircraft and used to produce the vapor or smoke.

Accordingly, as radio technology advanced, a system was devised wherein a single master aircraft would carry a transmitter and a program to transmit the message, with several receiving aircraft carrying receivers each receiving a discrete signal from the master aircraft to cause each receiving aircraft to produce a pulse of smoke or vapor automatically at the proper time. By flying the aircraft in a proper formation, each aircraft can simultaneously produce a portion of a message, thereby enabling the entire message to be completed much more quickly than by a single aircraft to reduce the effects of dissipation of the message and also allowing each aircraft to carry a smaller supply of vapor producing oil.

This basic concept of using several aircraft in formation is known as "Skytyping" ™. However, it is not widely used, as it also has certain disadvantages. For one thing, the transmission and reception system used, along with the message program, results in the individual message units or "smoke puffs" being produced in real time. This requires the aircraft to fly in a line abreast formation, i. e., spread laterally across the flight path. This type of formation flying is most difficult to perform, as each of the following pilots must focus and maintain their entire concentration upon the lead aircraft, ninety degrees to the direction of flight. Each pilot must have his/her head and neck turned in the direction of the lead aircraft during at least the entire message writing portion of the flight. This is not only tiring, but somewhat hazardous, as the aircraft are spread laterally on the order of two hundred feet apart, resulting in a spread of on the order of eight hundred feet between the aircraft at the extreme ends of the formation. With the pilots' attention being diverted from the direction of flight, the possibility of midair collision is relatively high.

The present invention overcomes these difficulties with a system which allows the aircraft to fly in a V or other formation, by adjusting the time for the transmission of the message signals according to the position of the individual aircraft in the formation. A discussion of the prior art known to the present inventor, and its differences and distinctions from the present invention, is provided below.

U.S. Pat. No. 1,426,413 issued on Aug. 22, 1922 to John C. Savage describes an Aerial Craft including a pair of tanks or hoppers each containing a substance which, when mixed together, will produce a visible vapor or smoke. The materials may be injected into the exhaust of the aircraft for distribution and further effect. Savage states that the use of a single material did not produce a sufficiently dense cloud of smoke, but the injection of a single material (i. e., oil) into the aircraft exhaust is commonly used today for such purposes. Savage is silent regarding the use of multiple aircraft in formation to produce an aerial message with the vapor output being controlled by a single aircraft in the formation, as provided by the present invention.

U.S. Pat. No. 1,850,635 issued on Mar. 22, 1932 to Willard Reed, Jr. describes a Method Of Forming Designs In The Sky. Reed, Jr. recognizes the difficulty in forming a legible word using a single aircraft, and the problems inherent in the use of one aircraft for such skywriting. Reed, Jr. thus uses a plurality of aircraft, each of which forms a single letter or a portion of a letter, in accordance with a predetermined pattern depending upon the specific word(s) or design(s) to be formed. The Reed, Jr. method differs from the present invention in that no communication is disclosed between aircraft or pilots while the aircraft are in flight, as provided by the present invention. The Reed, Jr. technique, while theoretically workable, is also potentially quite hazardous, with the aircraft involved crossing each others' flight paths several times during the forming of a single word or design.

U.S. Pat. No. 1,986,942 issued on Jan. 8, 1935 to John T. Remey describes an Apparatus For Sky Writing, comprising a perforated message sheet passing over a perforated track bar. The bar communicates pneumatically or optically with a series of relays activated when specific sheet and bar perforations are momentarily aligned as the sheet scrolls across the bar. The pneumatic portion of the system is similar to that used in the operation of a player piano or band organ. The relays each operate a valve, which emits a puff of smoke or vapor. The valves are all installed on a single tube trailed downwardly below a single aircraft in flight. Remey is silent regarding the use of multiple aircraft, or any means of display message communication between multiple aircraft.

U.S. Pat. No. 2,345,152 issued on Mar. 28, 1944 to John T. Remey describes Sky Writing With A Plurality Of Airplanes, wherein several slave aircraft each have a receiver which in turn selectively operates a smoke or vapor valve in that aircraft when a signal is received. Alternatively, the master signals may be transmitted by an aircraft in the formation, or by a transmitter on the ground, and the signal may be direct or may be an audio or visual signal to an operator in the aircraft. The automatic reception of transmitted signals by a master aircraft in the formation is loosely similar to the general procedure used in the present invention and is the foundation of the present "Skytyping" ™ technique, but Remey provides no delay means to allow any other type of formation than line abreast or a single echelon, which would result in a swept or italicized font for the message.

U.S. Pat. No. 2,674,820 issued on Apr. 13, 1954 to Rolf K. Hansen et al. describes the Production Of Smoke Signs In The Air. The system uses a plurality of identical perforated panels, but each panel is modified according to the position of the aircraft to use that panel, within the aircraft formation. This allows the master aircraft to transmit unmodulated signals using only a single frequency, with each of the slave aircraft receiving identical signals to advance the message panels identically. However, since each of the panels is modified according to the position of the aircraft carrying that panel, those aircraft having panel positions which have been blocked out at any specific point will not produce a smoke puff at that radio transmission. While the present invention may make use of a single radio frequency, the modulation of that frequency allows only the master aircraft to carry the message means, with the slave aircraft each having only a receiver and smoke generating means. This allows any aircraft using the present invention to transfer to any part of the formation, by switching the specific modulated signal received by the aircraft to receive a signal appropriate to another point in the formation. The transmitting aircraft does not alter the transmitted signal in any way for this change. This is advantageous in that some portions of Roman letters (e. g., top and bottom strokes) require more oil vapor than other portions. Thus, the present invention allows aircraft to change positions, so aircraft using more oil may switch with those using less oil, to prolong the flight and messages formed.

U.S. Pat. No. 3,151,410 issued on Oct. 6, 1964 to Anthony Stinis describes a Sky Writing Apparatus wherein a master aircraft carries at least one message scroll and transmitter, with each slave aircraft having a receiver tuned to receive only a single one of the transmitted frequencies (or specific modulations of a single frequency) of the master aircraft. This system differs from the Hansen et al. system discussed immediately above, in that Hansen et al. functions more like a synchronizing signal for the messages carried in each of the aircraft, rather than actually transmitting the message, as is done by Stinis and also in the present invention. However, Stinis provides no means for different aircraft to change relative positions in the formation during flight, as provided by the present invention. Stinis does not provide any alteration of the message unit transmissions from real time, thus requiring all aircraft to fly in a line abreast formation, unlike the present invention. Stinis provides for up to two different messages to be formed in a single flight. The present system is also capable of being used to form multiple messages in a single flight, and in fact can form any number of different messages, limited only by the amount of smoke or vapor producing agent aboard each aircraft.

U.S. Pat. No. 4,561,201 issued on Dec. 31, 1985 to George A. Sanborn describes a Method And Apparatus For Sky Typing, comprising a string of vapor producing canisters which are trailed below a single aircraft. Sanborn mentions a computer, but provides no specific information or disclosure of the hardware and programming.

Finally, British Patent Publication No. 2,191,319 published on Dec. 9, 1987 to David J. G. Martin describes A Sky Graphics System, wherein a single aircraft carries a manifold having a plurality of nozzles for the dispersion of visible vapor therefrom. Each nozzle is controlled by an electronic valve, with a portable computer controlling the apparatus. No preferred method of carrying out the invention, or reduction to practice, is disclosed in the British publication.

None of the above inventions and patents, taken either singly or in combination, is seen to describe the instant invention as claimed.

SUMMARY OF THE INVENTION

The present invention is an aerial message system comprising a plurality of aircraft with a master aircraft (with a radio transmitter) and several slave aircraft (each having a receiver). Each of the aircraft is equipped with smoke or vapor generating means, serving to produce visible messages in the sky for advertising or display purposes. A small computer in the master aircraft is used to enter the message (s) to be formed, with the computer communicating with the radio transmitter by means of an interface and encoder, which translates the computer output from a format for communicating with a dot matrix printer, to a format compatible for radio transmission of the signals. The receiver in each slave aircraft is adapted to receive a discretely modulated signal from the transmitter, for differentiation of the message output by the different aircraft.

When the signal is received by a given aircraft (including the master aircraft, where the interface and encoder output is hard wired to the smoke or vapor system) the smoke system causes a short pulse of smoke generating material (e. g., oil) to be injected into the exhaust of the aircraft's engine. This produces a short, highly visible puff of smoke or vapor which remains in the air behind the aircraft for some time. By coordinating the output signals, a coherent message may be formed by the aircraft flying in formation.

The computer allows the aircraft to fly in other than line abreast formation (e. g., V formation, echelon, etc.) as desired, by adjusting the transmitting signal to accommodate variations from the line abreast formation needed to form vertical strokes and upright letters in real time. Different aircraft in the formation may exchange places from time to time, in order to deplete the smoke generating material in each aircraft more evenly, by adjusting the appropriate receivers in the subject aircraft so they are responding to the signal in the new position in the formation. The computer may also be programmed to adjust the transmission duration (and thus the smoke pulse length) to accommodate different true airspeeds of the aircraft, and other factors as desired.

Accordingly, it is a principal object of the invention to provide an improved aerial message system.

It is another object of the invention to provide an improved aerial message system comprising a plurality of aircraft each providing smoke or vapor output controlled by a master aircraft.

It is a further object of the invention to provide an improved aerial message system which single master aircraft carries a computer with encoder and interface and a transmitter, with the encoder and interface accepting a format from the computer compatible with a dot matrix printer, and providing a separate output to the transmitter for each receiver of each slave aircraft.

An additional object of the invention is to provide an improved aerial message system which utilizes a receiver for each aircraft, each of which is adjusted to receive a specific input signal from the master aircraft, and which receivers may be readjusted in flight to enable different slave aircraft to exchange positions within the formation.

Still another object of the invention is to provide an improved aerial message system which master aircraft computer is programmable, to adjust signal transmission for different formation configurations, true airspeeds, and other factors as desired.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
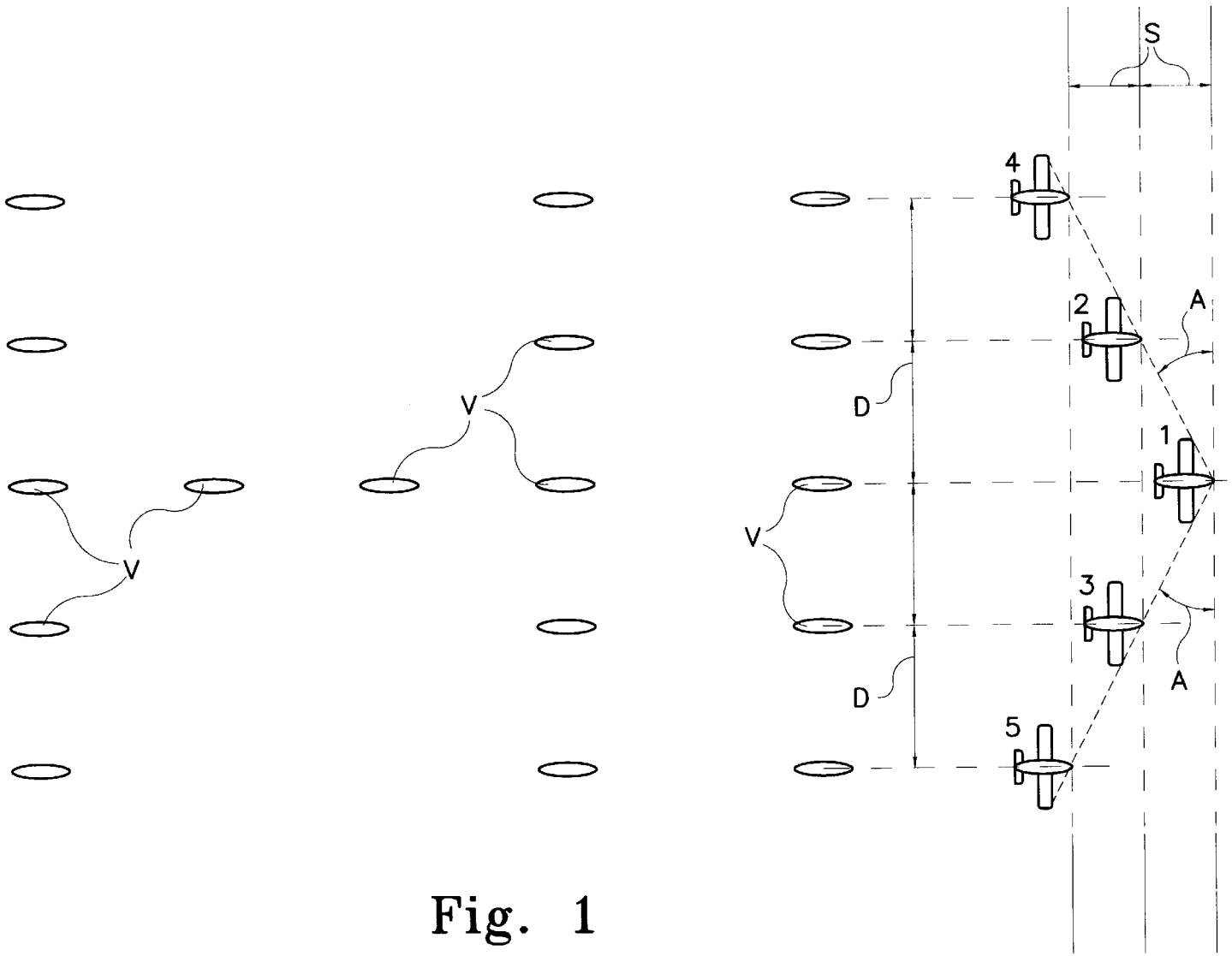
FIG. 1 is a schematic plan view of a five aircraft formation flight forming an aerial message, and showing exemplary relationships and spacing between the aircraft.

The present invention is an aerial message system, with aircraft flying in formation producing intermittent bursts of vapor in a predetermined array, to produce a coherent message when viewed from the ground. Preferably the aircraft are flown in V formation, as shown in FIG. 1. Such a V formation (or a rearwardly sweeping echelon) has advantages for the flight crew involved, in comparison with line abreast formations which must be used in other types of formation flying to produce aerial messages. When one lead aircraft is provided, with all other aircraft trailing behind and to the side(s), the pilots of the following (slave) aircraft are able to devote some of their attention along the path of flight, thus producing a safer flight, rather than looking ninety degrees to the side, as in a line abreast formation required with other systems.

Figure 2:
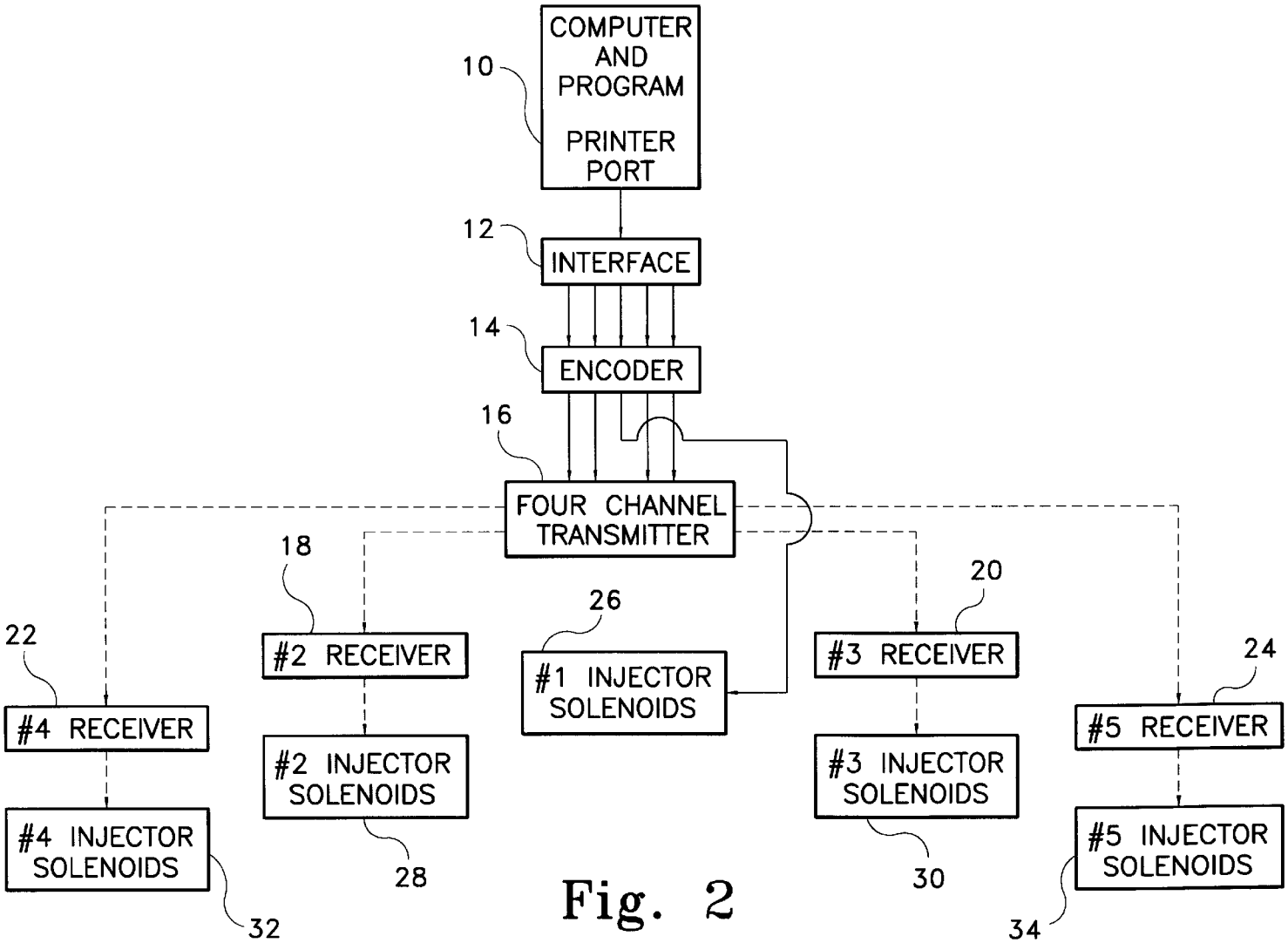
FIG. 2 is a block diagram of the basic components of the present aerial message system of each aircraft.

FIG. 2 provides a block diagram of the apparatus used in the aircraft of the present aerial message system. The lead, or master, aircraft (aircraft 1 at the center of the V formation in FIG. 1) carries a programmable computer 10 on board, with the computer being programmed with the various parameters of the particular flight, such as the message to be formed, the type of formation to be flown, the true airspeed, and the spacing of the aircraft. The computer 10 has a printer output port, for providing a signal to a printer or other device. It has been found that a vast number of portable (or "laptop") computers are suitable for the task required. For example, an IBM 365 laptop has been used successfully by the present inventor.

The computer is hard wired to an interface device 12, which accepts the signal from the computer printer port and is compatible with the computer 10, with the computer 10 behaving as though it is communicating with a dot matrix printer. The interface 12 accepts the message output and sends the message to an encoder 14 to which it is hard wired, as an array of separate data outputs or signals (e. g., five, for a five aircraft formation, with the number of data outputs corresponding to the number of aircraft in the formation). The encoder 14 is hard wired to a radio transmitter 16, which transmits the appropriate data outputs to the following or slave aircraft, e. g., aircraft 2, 3, 4, and 5 of the formation of FIG. 1. (It will be noted that the encoder 14 does not send the signal for the lead aircraft 1 to the transmitter 16, as the system receiving the lead aircraft signal is on board the aircraft.)

The transmitter 16 may utilize a single frequency to transmit each of the discrete signals developed by the encoder 14, by modulating the four different signals. An FM (frequency modulation) system based upon four channel radio control model aircraft equipment has been tested with good results. AM (amplitude modulation) transmitters may also be adapted for use in the present invention. The critical point is that the transmitter 16 provide four discrete signals, either by means of four different frequencies, or FM, AM, or pulse, etc. modulation of a single frequency.

Each of the slave aircraft 2, 3, 4, and 5 has a radio receiver on board, dedicated to the reception of the appropriate signals from the master aircraft transmitter 16. The four slave aircraft receivers are designated respectively as receivers 18, 20, 22, and 24. Each of these receivers 18 through 24 is tuned or adjusted to receive only one of the four discrete signals transmitted by the lead aircraft transmitter 16, and thus will respond only to the signal intended for that particular aircraft.

Each of the receivers 18 through 24 in each of the slave aircraft, respectively aircraft 2, 3, 4, and 5 of the formation, is hard wired to the vapor generation means aboard that particular aircraft. The present system utilizes a lightweight oil which is injected into the engine exhaust of each aircraft, with the oil producing a highly visible cloud of oil vapor as it is heated and expelled by the exhaust. The oil is injected into the exhaust system of each aircraft by an injector installed within the exhaust system of each aircraft 1 through 5. Each of these injectors (not shown) preferably includes a check valve, acting to provide a clean cutoff of the oil or fluid used to produce the vapor puffs forming the message and to preclude residual oil or fluid from boiling off or vaporizing within the exhaust stack after the injector has been deactivated. This provides a much cleaner puff of vapor for each dot or cloud puff forming the message.

These injectors are controlled by an injector solenoid aboard each of the aircraft 1 through 5, respectively designated as solenoids 26, 28, 30, 32, and 34. The number 1 aircraft injector solenoid 26 is hard wired from the encoder 14 aboard the lead or master aircraft 1, via electrical wiring 36. The remaining slave aircraft solenoids 28 through 34 receive signals from the respective radio receivers 18 through 24 aboard the respective aircraft 2 through 5. It will be seen that other vapor generation means may be used if desired (particulate dispersal, etc.), but the present oil vapor system has been found to work well.

The present aerial message system operates by entering the parameters of the flight (type of formation, spacing, true airspeed, message, etc.) into a specially adapted program in the computer. The aircraft 1 through 5 are flown to the desired site and altitude, and the pilots arrange the aircraft in the predetermined formation. The pilot of the lead or master aircraft 1 then initiates the message program on the computer 10, which sends signals to the interface device 12 on board the master aircraft 1 as though communicating with a dot matrix printer. The interface 12 differentiates the signals into a number of discrete signals appropriate to the number of aircraft in the formation, and sends the signals for the receiving or slave aircraft, e. g., aircraft 2 through 5 in FIG. 1, to the transmitter 14 aboard the master aircraft 1, from which the signals are transmitted to be received by the receivers in the slave aircraft, e. g., receivers 18 through 24 aboard the aircraft 2 through 5.

Each of the receivers 18 through 24 is tuned or adjusted to receive only a single one of the signals transmitted, according to the position of the corresponding aircraft in the formation, as described above. Thus, the far left hand aircraft 4 in FIG. 1 would only receive signals intended for the top of the letter being formed, while the far right aircraft 5 would only receive signals to form the bottom of the letter. (This explanation assumes the formation shown in FIG. 1 is being viewed from below.) As each receiver receives an appropriate signal, the injector aboard that aircraft is triggered, causing a short burst (approximately four tenths of a second, or about sixty feet of distance at the speed typically flown) of oil to be injected into the aircraft exhaust, thereby producing a puff of vapor V from the aircraft exhaust. Spacing between adjacent puffs is about two tenths of a second, or about thirty feet of distance. The above described process continues according to the message entered into the computer 10 aboard the master aircraft 1, until completion of the message.

Preferably, five aircraft are flown in a V formation, as shown in FIG. 1, but the present invention provides for other formation configurations as well (left and right echelon, etc.), by reprogramming the computer 10 used in the lead or master aircraft 1. Preferably, such formations are flown at an altitude on the order of two miles or so above the ground, in order to have smooth and stable air to enable the vapor messages formed to have a longer lifespan, and also to make the formation flying somewhat easier for the flight crews.

Due to the relatively high altitude, it is necessary to make the individual letters of a text message relatively large, on the order of eight hundred feet from top to bottom of each letter. Thus, each of the aircraft will be separated by a lateral distance D of two hundred feet, although this will depend upon the desired size of the formation and the number of aircraft used. Preferably, such a V formation is swept back at an angle A of 30 degrees from a reference line perpendicular to the line of flight. Again, other angles may be used. When a 30 degree sweepback is used, the corresponding forward and aft spacing S between aircraft will be half that of the lateral spacing, or in the example used herein, one hundred feet between each aircraft.

Due to the speed of the aircraft, this longitudinal spacing S results in the lead aircraft 1 arriving at a given point along the formation flight path, slightly before the other aircraft. At a true airspeed of ninety knots for such flying, each aircraft is covering about 150 feet per second. Thus, the intermediate aircraft 2 and 3 are about two thirds of a second behind the lead or master aircraft 1, with the left and right wing aircraft 4 and 5 being about one and one third seconds behind the lead aircraft 1. Yet, it is necessary to produce the vapor bursts or puffs V for the vertical portion of a letter, in exact alignment. A real time transmission of the signals to each of the aircraft, would result in the vapor emissions V being produced simultaneously, with the vertical strokes of the letters thus also being in a V formation, congruent to the aircraft formation.

The present aerial message system adjusts for this difference in longitudinal spacing in a V formation, by providing a time delay and adjusting the timing of the output signals from the computer 10, e. g., using the internal clock of the computer. In the above example, the computer 10 first sends a signal through the interface 12 and encoder 14 to the lead or master aircraft injector solenoid 26 via the hard wired connection 36. About two thirds of a second later, the computer 10 sends second signals through the interface 12 and encoder 14 to the transmitter 16, which transmits two different signals receivable by the receivers 18 and 20 of the intermediate aircraft 2 and 3 in the formation. This two thirds of a second delay results in the vapor emissions produced by the intermediate aircraft 2 and 3, being in exact lateral alignment with the initial vapor emission of the lead aircraft 1.

Two thirds of a second following the signals to the intermediate aircraft 2 and 3 (or one and one half second following the initial signal to the lead or master aircraft 1), the computer outputs two further signals to the left and right wing aircraft 4 and 5. The delay results in the vapor emissions produced by those aircraft, also being in precise alignment with the first vapor emission of the lead aircraft 1 at the head of the V formation, thus producing a precisely aligned vertical letter stroke. The process is continued in accordance with the message entered into the computer 10 until the message has been completed, such as the word "HI" containing three vertical strokes produced as described above, along with the single horizontal stroke.

It is well known that most upper case block letters, as used in the English alphabet, contain many more horizontal strokes at their extreme upper and lower ends than in their intermediate areas. Examples are the letters C (in block form), L, O (in block form), Q, T, U, and Z. While other letters contain central horizontal strokes (B, E, F, H, etc.) these strokes are generally shorter, and in any event, the intermediate points between the center of each letter and its upper and lower extremities are nearly devoid of any strokes other than verticals. Accordingly, it will be seen that more vapor will usually be required by the aircraft at the extremes of the V formation, i. e., aircraft 4 and 5 of FIG. 1, than will be required of the intermediate aircraft 2 and 3. The lead or master aircraft 1 will generally use an amount of vapor producing oil somewhere between the amount used by the extreme outboard aircraft 4 and 5, and the intermediate aircraft 2 and 3.

Assuming that the relative positions of the aircraft in the formation are fixed, the maximum length of a message will be limited by the amount of vapor producing oil carried by the two aircraft 4 and 5 at the extreme ends of the formation; this is true regardless of the type of formation flown (V, echelon, line abreast). Accordingly, the present invention provides means for interchanging the positions of any of the aircraft in the formation with one another, thus enabling aircraft which have been emitting a relatively large amount of oil vapor to exchange positions with aircraft which have been using relatively little oil.

Figure 3:
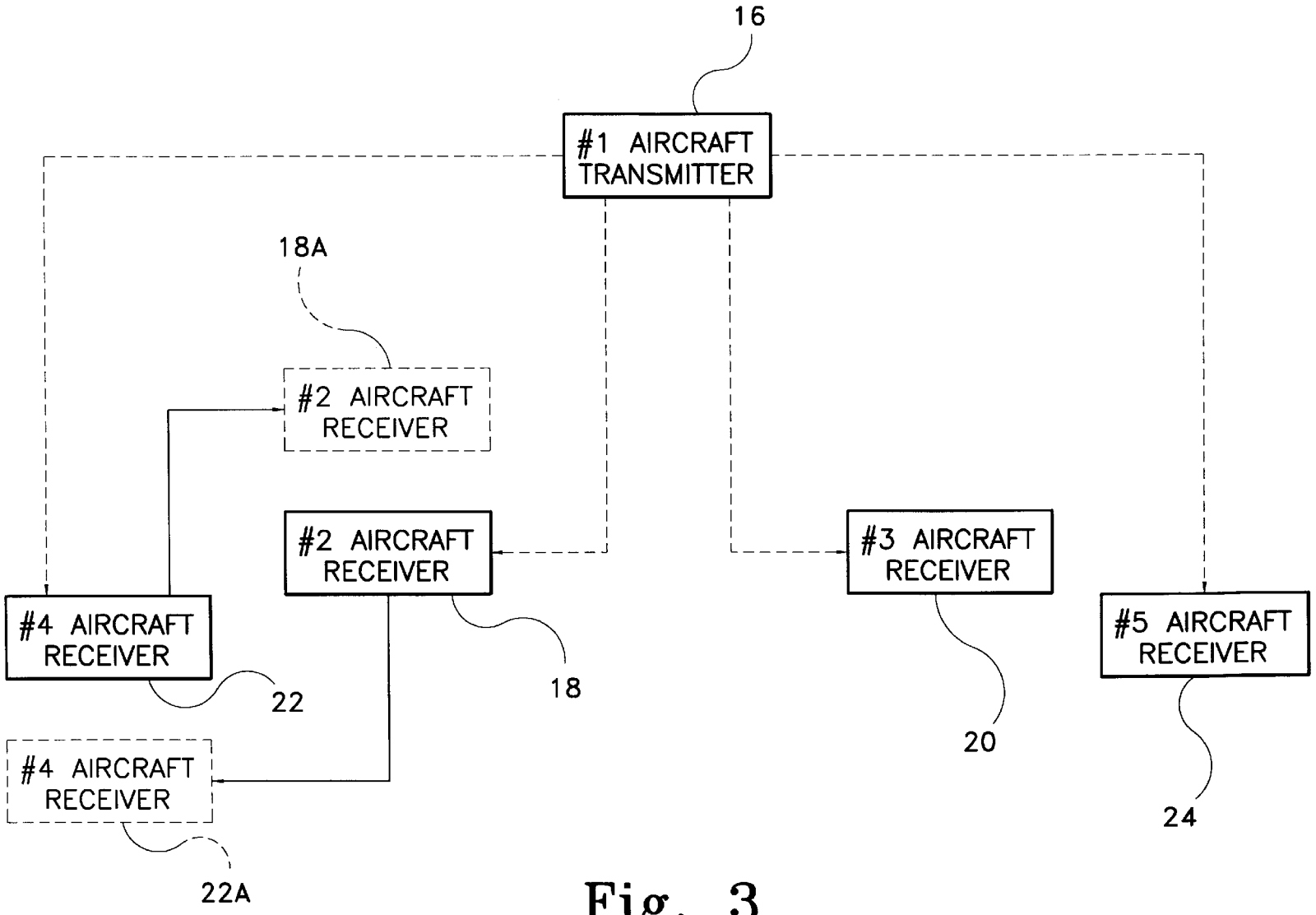
FIG. 3 is a schematic diagram showing the exchange of positions of two aircraft in a five aircraft V formation, and the readjustment of the respective receivers of those aircraft.

This exchange of positions is shown schematically in FIG. 3, with the five aircraft (and the lead aircraft transmitter 16 and following or slave aircraft receivers 18 through 24) initially in a V formation as shown in FIG. 1. The four receivers are provided with means of adjusting the signal received (changing frequency or otherwise tuning or adjusting the receivers as required and according to the principle used in the compatible transmitter 16). Thus, any receiving aircraft 2 through 5 may change positions with any other receiving aircraft by mutual agreement, with the two pilots merely readjusting their receivers to receive the signal originally intended for the receiver of the other aircraft with which they are exchanging positions.

In FIG. 3, the intermediate and outboard aircraft on the left side of the V formation, exchange positions. The pilots of these aircraft each adjust their receivers, respectively receivers 18 and 22. The new aircraft and receiver positions in the formation are shown in broken lines, with the original number four aircraft receiver 22 being adjusted to the original setting of the number two aircraft receiver 18 and indicated as receiver 18*a*, and the number two aircraft receiver 18 being adjusted to the original setting of the number four aircraft receiver 22, with that receiver now being designated as number two aircraft receiver 22*a*. Thus, the aircraft in their new positions in the formation will have their receivers tuned or adjusted to receive the signals appropriate to their new positions in the formation, with the vapor output still being in the proper relative positions.

It will be seen that a mirror image of this position exchange may be accomplished with the two right side aircraft 3 and 5, as desired or required. For that matter, either of the receiving aircraft on the left side or wing of the formation may change places with either of the receiving aircraft on the right side of the formation, as desired, although this typically is not necessary. By having the intermediate and outboard aircraft exchange positions at some intermediate point during the message flight, the amount of vapor producing oil or substance on board the aircraft may be most efficiently used, with the amount used averaging out over the duration of the message production, thus allowing longer and/or more messages to be produced during a single flight than would be the case if only one or two aircraft out of the formation depleted their vapor material first while the others still had a good supply.

In summary, the above described aerial message system will be seen to provide a significant advance in the aerial message or advertising industry where smoke or other vapor is used to produce an aerial message visible from the ground. The present system is relatively light in weight, and may be incorporated in smaller aircraft than those traditionally used in formation aerial message flying, thus saving considerably on operating costs. While smaller aircraft may not have the vapor material capacity (oil tank capacity) of larger aircraft, the ability of the present system to allow aircraft to exchange positions within the formation serves to optimize the volume of vapor material carried in the aircraft.

This ability to exchange positions also allows the formation of more or longer messages per flight, thus reducing the number of long climbs and descent to and from altitude, and the time and fuel expended on such climbs and descents, thus further reducing the cost per message when using the present system.

The present system also allows the use of formations other than line abreast, which heretofore were required in such formation aerial message flying due to the real time transmission of signals to each of the aircraft within the formation. Pilots were forced to fly their aircraft in a line abreast formation, with the accompanying potential hazard and fatigue of having one's head turned ninety degrees to the side for virtually the entire duration of the formation portion of the flight. The present system, with the time delay means provided for the signal output to trailing aircraft, allows the aircraft to be flown in a safer V or echelon formation than the line abreast required by conventional formation aerial message systems. In fact, the present system is not limited to having the lead or master aircraft at the front of the formation, although this is typically the configuration of the formation. The lead aircraft (i. e., the aircraft carrying the transmitter) could be positioned at any point in the formation, with the computer being programmed accordingly. Thus, the present aerial message system is highly versatile and overcomes many of the problems of the earlier developed, conventional systems requiring line abreast aerial message formations.

It is to be understood that the present invention is not limited to the sole embodiment described above, but encompasses any and all embodiments within the scope of the following claims.

I claim:

1. An aerial message system for use by a single master aircraft and a plurality of slave aircraft flying in formation with one another, with at least one of the aircraft of the formation positioned generally rearwardly of at least one other aircraft of the formation, said aerial message system comprising:

a programmable computer adapted to be installed aboard the master aircraft, said computer having at least a printer signal output port for outputting messages according to programmed parameters entered into said computer;

an interface device adapted to be installed aboard the master aircraft and communicating with said computer through said printer signal output port thereof, for accepting said messages from said computer in a format compatible with a dot matrix printer and outputting a signal representative of said messages;

an encoder adapted to be installed aboard the master aircraft and communicating with said interface device, for encoding said signal from said interface device and for providing a plurality of discrete signals, with each of said discrete signals corresponding to a position of one of the aircraft of the formation;

a radio transmitter adapted to be installed aboard the master aircraft and communicating with said encoder, for transmitting said discrete signals to each of the slave aircraft;

a radio receiver adapted to be installed aboard each of the slave aircraft for receiving said discrete signals transmitted from said transmitter, each said radio receiver being adjusted for receiving only one of said discrete signals in accordance with the position of the slave aircraft in the formation;

vapor generation means for generating vapor, said vapor generation means adapted to be installed aboard each aircraft; and a hard wired connection between said encoder and said vapor generation means installable aboard the master aircraft;

wherein each said radio receiver communicates with respective said vapor generation means installable aboard a respective one of the slave aircraft, and;

wherein said receiver installable aboard the at least one rearwardly positioned aircraft includes adjusting means for receiving a different discrete signal for a different aircraft of the formation, for exchanging positions in the formation between different aircraft.

2. The aerial message system according to claim 1, wherein said radio transmitter includes means for modulating said discrete signals to provide modulated discrete signals and for transmitting said modulated discrete signals as separate transmitted signals, with each of said separate transmitted signals being received by only a single one of said receivers installable aboard a respective one of the slave aircraft according to the position of the respective one of the slave aircraft in the formation.

3. The aerial message system according to claim 1, wherein said computer installable aboard the master aircraft includes time delay means for compensating for relative forward and rearward positions of the formation aircraft.

4. The aerial message system according to claim 1, wherein the aerial message system is adapted to be used with formation aircraft flying in a V formation comprising from left to right a rearwardly positioned number four slave aircraft, a number two slave aircraft, a forwardly positioned number one master aircraft, a number three slave aircraft, and a rearwardly positioned number five slave aircraft, wherein said computer installable aboard the master aircraft provides a signal compatible with a five pin dot matrix printer and includes time delay means for compensating for relative forward and rearward positions of the formation aircraft, and said encoder provides corresponding first, second, third, fourth, and fifth discrete signals, with each said second, third, fourth, and fifth discrete signals being sent to said transmitter, transmitted by said transmitter, and received by each said radio receiver installable aboard the corresponding number two, number three, number four, and number five aircraft and said first discrete signal being sent to said vapor generation means installable aboard the master aircraft.

5. The aerial message system according to claim 4, wherein said receivers installable aboard the number two, number three, number four, and number five aircraft each include adjusting means for receiving a different discrete signal for a different aircraft of the formation, for exchanging positions in the formation between different aircraft.

6. An aerial message system including a single master aircraft and a plurality of slave aircraft flying in formation with one another, with at least one of the aircraft of the formation positioned generally rearwardly of at least one other aircraft of the formation, comprising in combination:

a programmable computer installed aboard said master aircraft and having at least a printer signal output port, for outputting messages from said printer signal output port according to programmed parameters entered into said computer;

an interface device installed aboard said master aircraft and communicating with said computer through said printer signal output port thereof, for accepting a signal from said computer in a format compatible with a dot matrix printer;

an encoder installed aboard said master aircraft and communicating with said interface device, for encoding the signal from said interface device and for providing a plurality of discrete signals, with each of the signals corresponding to a position of one of said aircraft of said formation;

a radio transmitter installed aboard said master aircraft and communicating with said encoder, for transmitting said discrete signals to each of said slave aircraft;

a radio receiver installed aboard each of said slave aircraft for receiving the signals transmitted from said transmitter, with each said receiver being adjusted to receive only one of the signals in accordance with the position of the corresponding said aircraft in said formation;

vapor generation means installed aboard each said aircraft, with each said radio receiver communicating with respective said vapor generation means of a respective one of said slave aircraft, and;

a hard wired connection between said encoder and said vapor generation means of said master aircraft;

wherein said receiver of said at least one rearwardly positioned aircraft includes adjusting means for receiving a different discrete signal for a different said aircraft of said formation, for exchanging positions in said formation between different said aircraft.

7. The aerial message system and aircraft combination according to claim 6, wherein said radio transmitter includes means for modulating the discrete signals provided by said encoder and for transmitting the modulated signals as separate signals, with each of the signals being received by only a single one of said receivers of a respective one of said slave aircraft according to the position of said respective slave aircraft in said formation.

8. The aerial message system and aircraft combination according to claim 6, wherein said computer of said master aircraft includes time delay means for compensating for relative forward and rearward positions of said formation aircraft.

9. The aerial message system and aircraft combination according to claim 6, wherein said formation of said aircraft is a V formation comprising from left to right a rearwardly positioned number four slave aircraft, a number two slave aircraft, a forwardly positioned number one master aircraft, a number three slave aircraft, and a rearwardly positioned number five slave aircraft, wherein:

said computer of said master aircraft provides a signal compatible with a five pin dot matrix printer and time delay means adjusting for relative forward and rearward positions of said formation aircraft, and said encoder provides corresponding first, second, third, fourth, and fifth discrete signals, with second, third, fourth, and fifth discrete signals being sent to said transmitter and transmitted and received by said receivers of the corresponding number two, number three, number four, and number five said aircraft, and the third discrete signal being sent to said vapor generation means of said master aircraft.

10. The aerial message system and aircraft combination according to claim 9, wherein said receivers of said number two, number three, number four, and number five aircraft each include adjusting means for receiving a different discrete signal for a different said aircraft of said formation, for exchanging positions in said formation between different said aircraft.

11. A method of producing aerial messages using a single master aircraft and a plurality of slave aircraft in formation flight, with the master aircraft including a programmable computer with at least a printer signal output port, an interface device, an encoder, a transmitter, and vapor generation means aboard the master aircraft and a receiver adjusted to receive a discrete signal and vapor generation means aboard each of the slave aircraft, the method comprising the steps of:

(a) programming the computer with parameters relating to the flight, with the parameters at least including the message to be formed, the true airspeed of the aircraft, the spacing of the aircraft, and the type of formation to be flown;

(b) sending a message output from the printer signal output port of the computer in a format compatible with a dot matrix printer to the interface device, according to the programmed parameters entered into the computer;

(c) forming a plurality of discrete signals with the interface device, with each of the discrete signals corresponding to a respective one of the aircraft in the formation and one of the discrete signals corresponding to the master aircraft, and sending the discrete signals from the interface device to the encoder;

(d) sending the discrete signals corresponding to a respective one of the slave aircraft from the encoder to the transmitter;

(e) transmitting the discrete signals to the receiver in each of the slave aircraft in accordance with the position of the respective slave aircraft in the formation;

(f) sending the discrete signal corresponding to the master aircraft to the vapor generating means of the master aircraft;

(g) sending the discrete signal received by the receiver in each of the slave aircraft to the vapor generating means of each respective slave aircraft, causing an aerial message to be generated by the aircraft in accordance with the position of each of the aircraft in the formation;

(h) adjusting the receivers of at least two of the slave aircraft to receive the discrete signal of the other; and (i) flying the aircraft to exchange their relative positions in the formation.

12. The method of producing aerial messages according to claim 11, further including the steps of:

(a) modulating the discrete signals transmitted by the transmitter, and;

(b) adjusting each of the receivers to receive a different one of the transmitted discrete signals in accordance with the position of the respective slave aircraft in the formation.

13. The method of producing aerial messages according to claim 11, further including the steps of:

(a) positioning at least one of the aircraft of the formation, rearwardly of at least one of the other aircraft of the formation; and (b) initiating a time delay with the computer to adjust for the forward and rearward positioning of the aircraft in the formation.

14. The method of producing aerial messages according to claim 11, further including the steps of:

(a) forming a V formation with the aircraft;

(b) designating the aircraft in the V formation from left to right as a rearwardly positioned number four slave aircraft, a number two slave aircraft, a forwardly positioned number one master aircraft, a number three slave aircraft, and a rearwardly positioned number five slave aircraft;

(c) initiating a time delay with the computer to adjust for the forward and rearward positioning of the aircraft in the formation;

(d) sending a signal compatible with a five pin dot matrix printer from the computer to the encoder;

(e) forming corresponding first, second, third, fourth, and fifth discrete signals with the encoder;

(f) sending second, third, fourth, and fifth discrete signals from the encoder to the transmitter for transmission to the respective second, third, fourth, and fifth slave aircraft, and;

(g) sending the first discrete signal to the vapor generation means of the master aircraft.

* * * * *